US010427766B2

(12) United States Patent
Myerscough et al.

(10) Patent No.: US 10,427,766 B2
(45) Date of Patent: Oct. 1, 2019

(54) FRONT LINE KITE DEPOWER SYSTEM

(71) Applicant: Ocean Rodeo Sports Inc., Victoria (CA)

(72) Inventors: Richard Kerr Myerscough, Victoria (CA); Ross Davis Harrington, Victoria (CA)

(73) Assignee: OCEAN RODEO SPORTS INC., Victoria (CA)

( * ) Notice: Subject to any disclaimer, the term of this patent is extended or adjusted under 35 U.S.C. 154(b) by 374 days.

(21) Appl. No.: 15/485,651

(22) Filed: Apr. 12, 2017

(65) Prior Publication Data

US 2017/0297662 A1 Oct. 19, 2017

Related U.S. Application Data

(60) Provisional application No. 62/323,533, filed on Apr. 15, 2016.

(51) Int. Cl.
*B63B 35/79* (2006.01)

(52) U.S. Cl.
CPC ..... *B63B 35/7979* (2013.01); *B63B 35/7993* (2013.01)

(58) Field of Classification Search
CPC ..... B63B 35/7979; B63B 35/7993; B63B 35/7976
See application file for complete search history.

(56) References Cited

U.S. PATENT DOCUMENTS 6,581,879 B2 6/2003 Bellacera
6,691,954 B1 2/2004 Harrington et al.
6,869,047 B2 * 3/2005 Pouchkarev ..... B63B 35/7933 244/152
7,036,771 B1 5/2006 Pouchkarev
7,413,146 B2 8/2008 Quijano
7,581,701 B2 9/2009 Logosz et al.
7,810,759 B2 * 10/2010 Eberle ..... B63B 35/7979 244/155 A
8,398,030 B2 * 3/2013 Lawson ..... B63B 35/7979 244/155 A
8,459,595 B2 * 6/2013 Logosz ..... B63B 35/7979 244/155 A
9,469,386 B2 10/2016 Hastilow et al.
2008/0035796 A1 * 2/2008 See ..... B63B 35/7933 244/155 A
2015/0108279 A1 * 4/2015 Enserink ..... B63H 9/0685 244/155 A
2017/0050729 A1 * 2/2017 Enserink ..... B63B 35/7979
2019/0112043 A1 * 4/2019 Harrington ..... B64C 31/06

* cited by examiner

*Primary Examiner* — Marc Burgess

(74) *Attorney, Agent, or Firm* — Davis & Bujold PLLC; Michael J. Bujold

(57) ABSTRACT

A front flying line kite depower system includes a line sheath that extends through a transverse opening in the control bar. A front flying line parting fitting is non-rotatably fixed to an upper end of the line sheath above the control bar. When a manual rotation force is imparted to the line sheath, the relative positioning of a first front flying line and a second front flying line is altered by the front flying line parting fitting to untangle any twisting above the line sheath. Within the line sheath, the second front flying line is off-set from a primary axis and orbits the first front flying line which is positioned on the primary axis to avoid any tangling during manual adjustment.

2 Claims, 11 Drawing Sheets

FRONT LINE KITE DEPOWER SYSTEM

FIELD

There is described a front flying line kite depower system used in kite boarding.

BACKGROUND

An important safety feature is the ability to rapidly depower a kite. A number of kite depower systems have been proposed and are discussed in the following patents: U.S. Pat. No. 6,581,879 (Bellacera) titled: "Kite control system"; U.S. Pat. No. 6,691,954 (Harrington et al) titled: "Integrated kite control bar and controlled tension release safety device"; U.S. Pat. No. 7,036,771 (Pouchkarev) titled: Kite safety, control, and rapid depowering apparatus"; U.S. Pat. No. 7,413,146 (Quijano) titled: "Control apparatus for kite powered conveyance device"; U.S. Pat. No. 7,581,701 (Logosz) titled: "Kite control device"; and U.S. Pat. No. 9,469,386 (Hastilow) titled" Device for coupling of kite lines".

The Hastilow reference has the following to say regarding kite lines:

"A kite surfer is attached to a kite by a plurality of lines, which make up the kite control system. There are lines for piloting or controlling the kite, a traction line for transferring traction forces from the kite to the rider to propel the rider, lines to assist the rider in re-launching the kite from water and a leash to generally tether a rider to a non-flying or depowered kite so that the kite is not carried away and lost. All of these lines must somehow be attached to or controlled by the rider."

"One problem that exists is that kite lines become twisted when performing tricks and jumps. Accordingly there exists a need for a device for coupling kite lines that ameliorates twisting of lines or that at least provides a way for a rider to more easily remove twists in kite lines."

According to the teachings of Hastilow, there are two independently releasable couplings for the depower and landing lines. In addition, the preferred embodiment has a leash attachment rotatable about a rotational centre line for attachment of a kite retaining leash. Because the leash attachment is freely rotatable with respect to the control bar and harness loop about a co-linear rotational axis, twisting of the leash is ameliorated when the harness loop or the control bar is rotated to untwist the front and rear lines.

SUMMARY

There is provided a front flying line kite depower system which includes an elongated control bar having a centrally disposed transverse opening defining a primary axis. A line sheath extends through the transverse opening in the control bar. The line sheath has a lower end and an upper end. A manual rotation grip is fixed to the line sheath, whereby the line sheath is manually rotated. A front flying line parting fitting is non-rotatably fixed to the upper end of the line sheath above the control bar. The front flying line parting fitting has a first branch and a second branch, with the second branch diverging from the first branch. A front flying line connection assembly is positioned below the control bar, the front flying line connection assembly having an opening aligned with the primary axis. A release cuff with a connection loop forms part of the front flying line connection assembly. A tubular rotatable hub is concentrically positioned in the opening of the front flying line connection assembly. A first front flying line passes through the first branch of the front flying line parting fitting, extending down the line sheath and passing along the primary axis through the rotatable hub positioned in the opening of the front flying line connection assembly. A depowering safety line is connected to the first front flying line along the primary axis and extends below the front flying line connection assembly. A second front flying line passes through the second branch of the front flying line parting fitting, extending down the line sheath and connecting, off-set from the primary axis, to one of the lower end of the line sheath or the rotatable hub. The lower end of the line sheath is non-rotatably coupled with the rotatable hub. When a manual rotation force is imparted to the line sheath via the manual rotation grip, both the line sheath and the rotatable hub rotate. As the front flying line parting fitting rotates with the line sheath, the relative positioning of the first front flying line and the second front flying line is altered to untangle any twisting of the first front flying line and the second front flying line above the line sheath. Within the line sheath, the second front flying line, which is off-set from the primary axis, orbits the first front flying line positioned on the primary axis to avoid any tangling of the first front flying line and the second front flying line during manual adjustment.

The front flying line kite depower system, as described above, provides a way for a rider to more easily remove twists in kite lines.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A front flying line depower system 1 will now be described with reference to FIG. 1 through FIG. 11.

Figure 1:
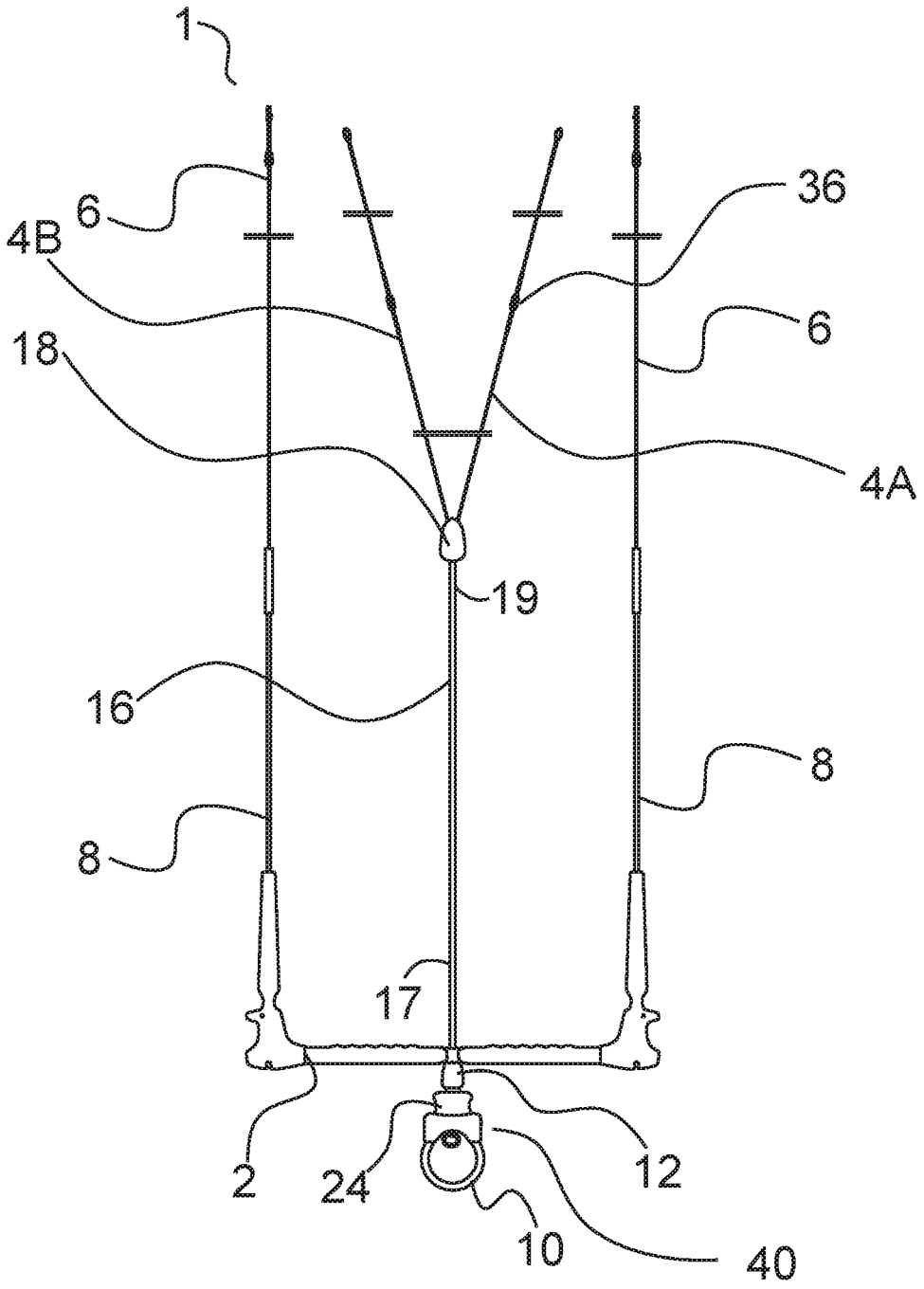
FIG. 1 is a front elevation view of a front flying line kite depower system.
Figure 2:
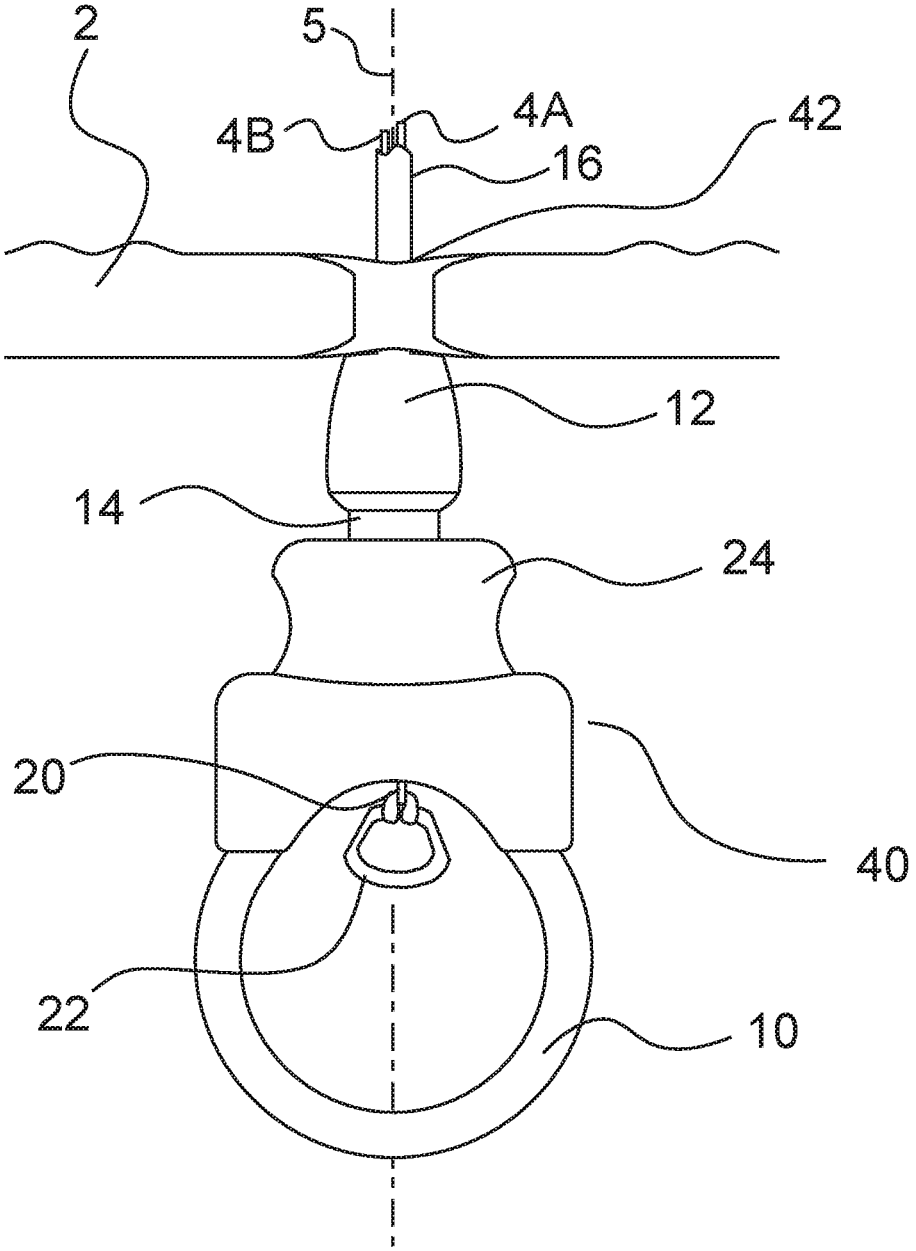
FIG. 2 is a detailed front elevation view of a control bar and a front flying line connection assembly of the front flying line kite depower system of FIG. 1.
Figure 3:
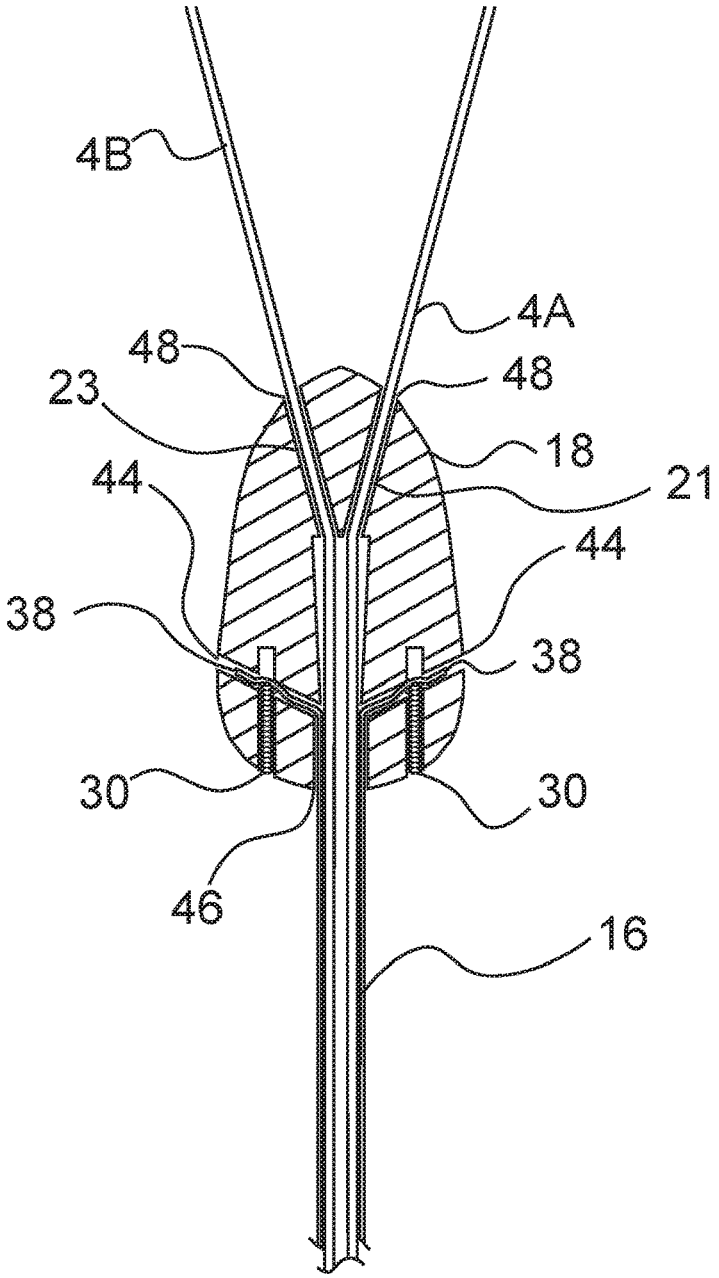
FIG. 3 is a detailed front elevation view, in section, of a front flying line parting fitting of the front flying line kite depower system of FIG. 1.
Figure 5:
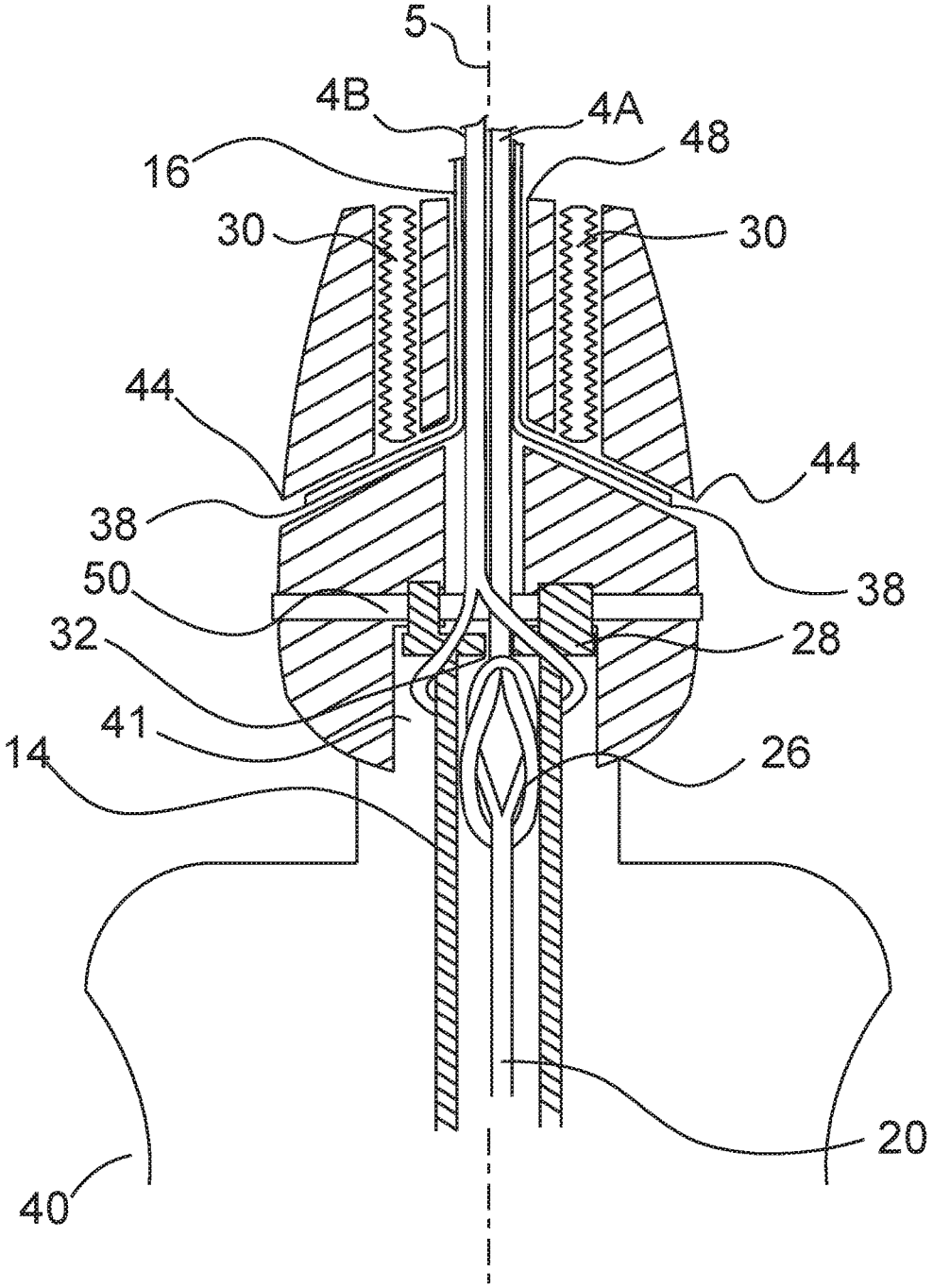
FIG. 5 is a detailed front elevation view, in section, of a manual rotation cap and a rotation hub of the front flying line kite depower system of FIG. 1.
Figure 7:
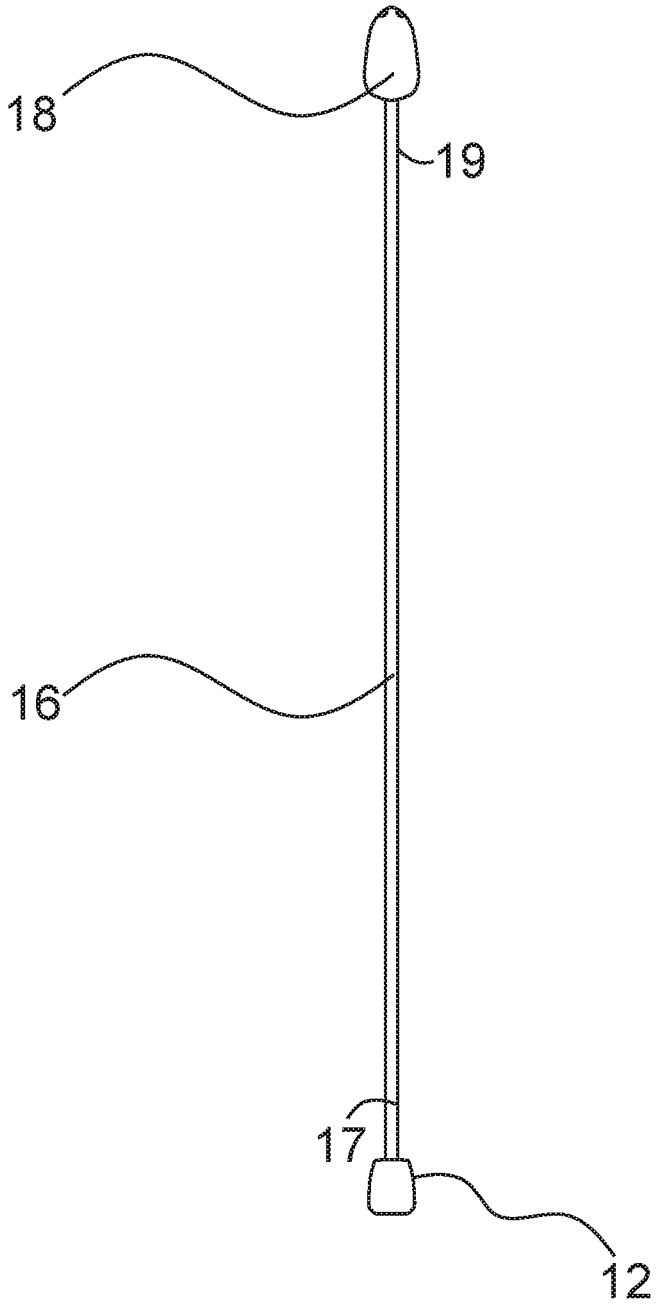
FIG. 7 is a front elevation view of a line sheath of the front flying line kite depower system of FIG. 1, with front flying line parting fitting and manual rotation cap attached.
Figure 9:
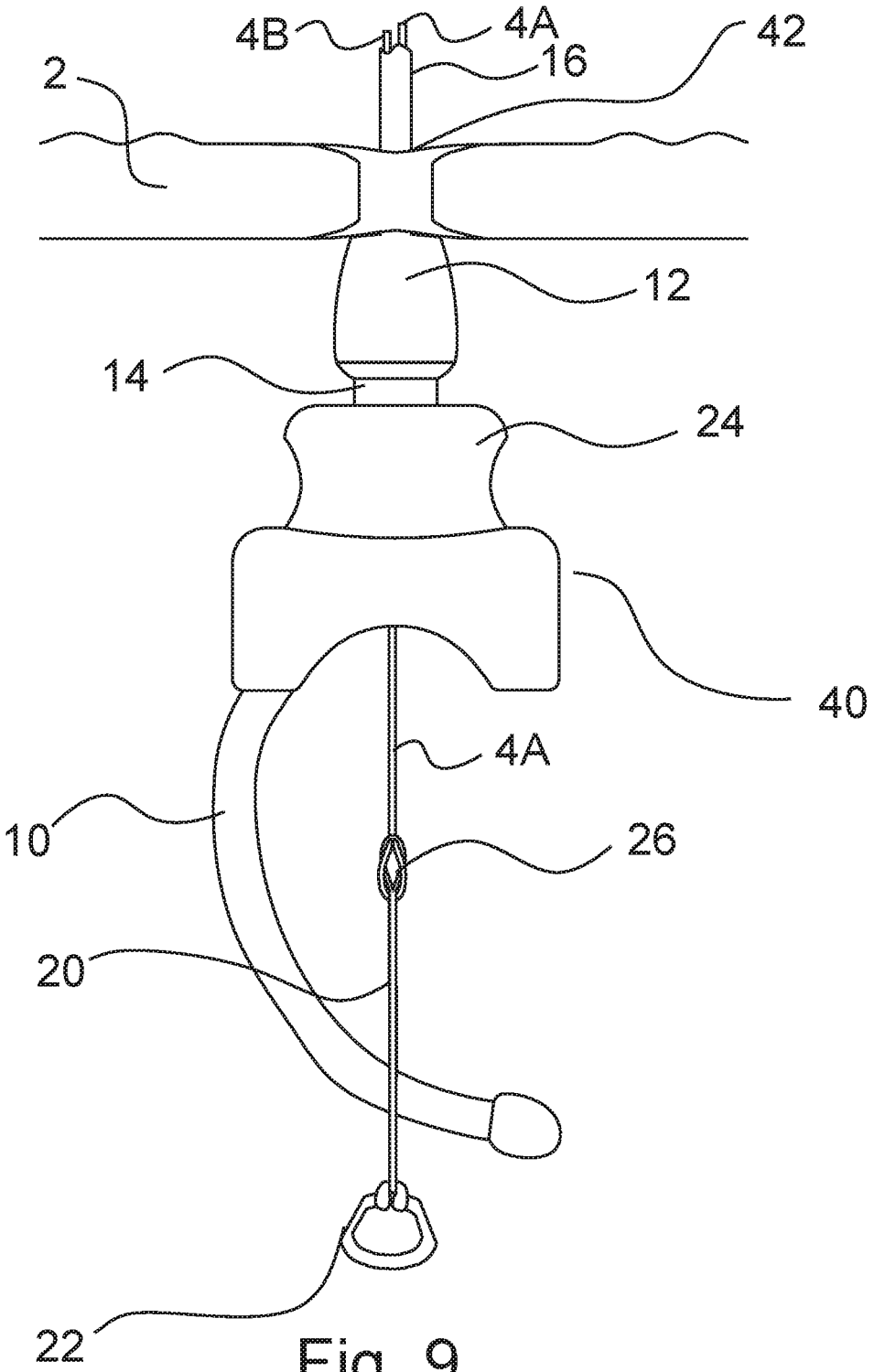
FIG. 9 is a front elevation view of the front flying line connection assembly of FIG. 2 with a connection loop in an open release position.

Structure and Relationship of Parts:

Referring to FIG. 2, front flying line kite depower system 1 includes an elongated control bar 2 having a centrally disposed transverse opening 42 defining a primary axis 5 (as indicated in broken lines). A line sheath 16 extends through transverse opening 42 in the control bar 2. Referring to FIG. 7, line sheath 16 has a lower end 17 and an upper end 19. A manual rotation grip, in the form of a manual rotation cap 12 is fixed to line sheath 16, whereby line sheath 16 is manually rotated. Manual rotation cap 12 is shown as being a lower end 17 of line sheath 16. It will be appreciated that it has been positioned there, as it is below control bar 2 and easy to reach. However, manual rotation grip does not have to be in the form of a cap and does not have to be positioned at lower end 17. Subject to the ability to conveniently reach manual rotation grip, manual rotation grip could be positioned above control bar 2 anywhere along line sheath 16. A front flying line parting fitting 18 is non-rotatably fixed to upper end 19 of line sheath 16 and, with reference to FIG. 1, will always be above control bar 2. Referring to FIG. 3, front flying line parting fitting 18 has a first branch 21 and a second branch 23, with second branch 23 diverging from first branch 21. Referring to FIG. 2 and FIG. 9, a front flying line connection assembly 40 is positioned below control bar 2. Referring to FIG. 5, front flying line connection assembly 40 has an opening 41 which is aligned with primary axis 5. Referring to FIG. 5 and FIG. 9, a release cuff 24 with a connection loop 10 forms part of front flying line connection assembly 40. Referring to FIG. 5, a tubular rotatable hub 14 is concentrically positioned in opening 41 of front flying line connection assembly 40. Referring to FIG. 3, a first front flying line 4A passes through first branch 21 of front flying line parting fitting 18, extending down line sheath 16. Referring to FIG. 5, first front flying line 4A passes along primary axis 5 through rotatable hub 14 positioned in opening 41 of front flying line connection assembly 40. A depowering safety line 20 is connected to first front flying line 4A along primary axis 5 and extends below front flying line connection assembly 40. Referring to FIG. 3, a second front flying line 4B passes through second branch 23 of front flying line parting fitting 18, extending down line sheath 16. Referring to FIG. 5, second front flying line 4B connects, off-set from primary axis 5, to one of lower end 17 of line sheath 16 or rotatable hub 14. In FIG. 5, second front flying line 4B has been shown connected to rotatable hub 14. Lower end 17 of line sheath 16 is non-rotatably coupled with rotatable hub 14 by a pin connection 50, as will hereinafter further described. More details of the illustrated embodiment will now be provided in the description which follows.

FIG. 1 is a front view showing the control bar 2, rear line leaders 8 that connect to the ends of the control bar and to the rear flying lines 6. Front flying lines (first front flying line 4A and second front flying line 4B) that have a front flying line to front flying line connection 36. Front flying line parting fitting 18 connects to a rotation sheath 16, the rotation sheath 16 then connects to a manual rotation cap 12, the manual rotation cap 12 connects to the manual rotation hub 14 which allows the manual rotation cap 12, rotation sheath 16 and front flying line parting fitting 18 to rotate as a unit so that the user can unwind twists in the front flying lines (first front flying line 4A and second front flying line 4B). The front flying line connection assembly 40 has a release cuff 24 that when activated opens the connection loop 10 that connects to a harness worn by the user.

FIG. 2 is a front view showing the control bar 2 with the rotation sheath 16 passing through an opening 42 in the control bar 2 and then connecting to the manual rotation cap 12. The front flying lines (first front flying line 4A and second front flying line 4B) pass through the rotation sheath 16 and then enter the manual rotation hub 14. Second front flying line 4B is terminated inside the manual rotation hub 14 and first front flying line 4A connects to a safety line 20 which in turn connects to a leash connection ring 22.

FIG. 3 is a front cross sectional view of the front flying line parting fitting 18. The end of the rotation sheath 16 has been split in half lengthwise forming two rotation sheath flaps 38. The rotation sheath 16 enters the bottom opening 46 and then the rotation sheath flaps 38 fit into slots 44 in the front flying line parting fitting 18 and are then held in place by set screws 30, making a solid connection. First front flying line 4A and second front flying line 4B enter the top of the front flying line parting fitting 18 through the top openings 48 with first front flying line 4A passing through first branch 21 and second front flying line 4B passing through second branch 23 and then both first front flying line 4A and second front flying line 4B pass down through the rotation sheath 16.

FIG. 5 is a front cross sectional view of the manual rotation cap 12 and the manual rotation hub 14. The manual rotation cap 12 is fixed to the manual rotation hub 14 by a pin 50 that passes through both parts. The end of the rotation sheath 16 has been split in half lengthwise forming two rotation sheath flaps 38. The rotation sheath 16 enters the top opening 48 and then the rotation sheath flaps 38 fit into slots 44 in the manual rotation cap 12 and are then held in place by set screws 30, making a solid connection. Second front flying line 4B exits the rotation sheath 16 and then attaches to front flying line termination attachment 28 which is part of manual rotation hub 14. First front flying line 4A exits rotation sheath 16 and then passes through the reduced diameter passageway 32 in the manual rotation hub 14 and then connects to the safety line 20 via a safety line to front flying line connection 26.

FIG. 7 is a front view showing the front flying line parting fitting 18 permanently attached to rotation sheath 16 and rotation sheath 16 permanently attached to manual rotation cap 12. Manually rotating any part of this assembly will unwind the first front flying line 4A and second front flying line 4B. No tension from first front flying line 4A or second front flying line 4B is applied to this assembly.

Figure 8:
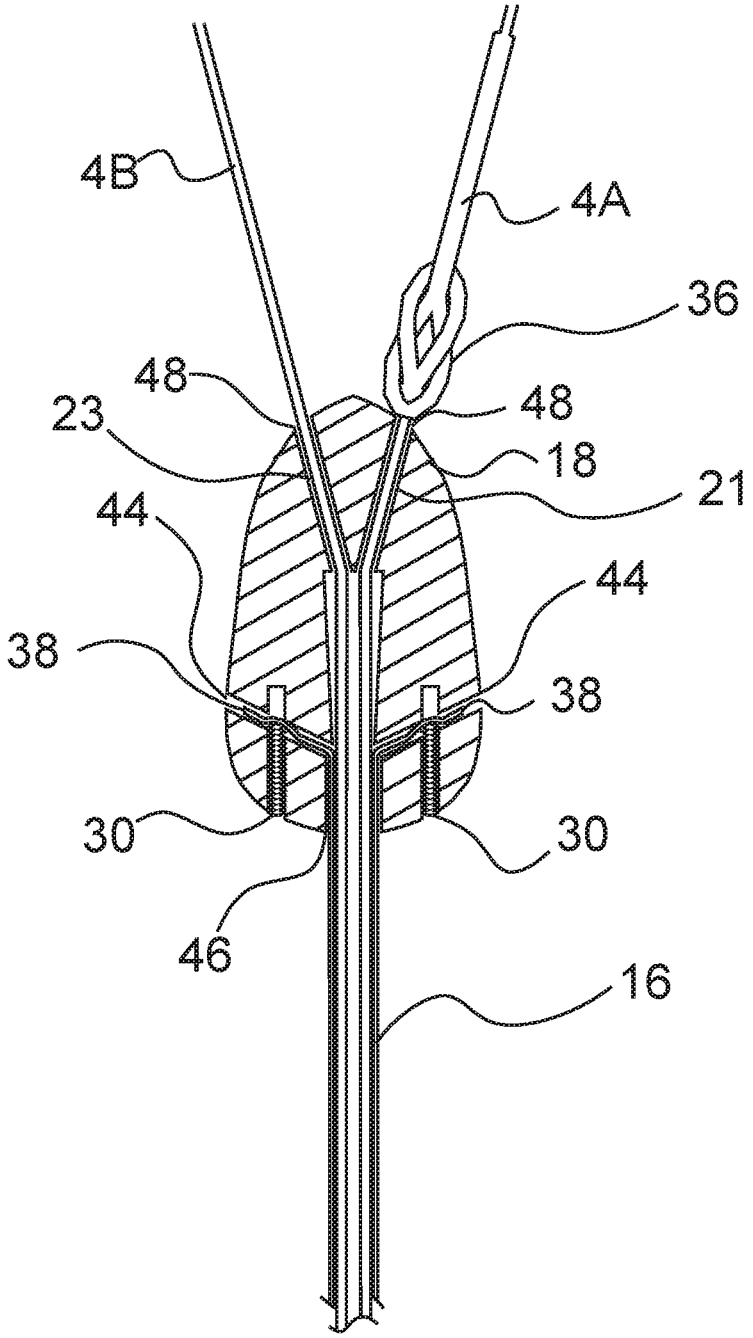
FIG. 8 is a detailed front elevation view, in section, of the front flying line parting fitting of FIG. 3 with a front flying line to front flying line connection serving as an upper limit stop.

FIG. 8 is a front cross sectional view of the front flying line parting fitting 18 showing how when first front flying line 4A, that is connected to the safety line 20, is pulled through the front flying line parting fitting 18; the front flying line to front flying line connection 36 prevents the front flying line parting fitting 18 from traveling all the way to the kite 56.

FIG. 9 is a front view of the front flying line connection assembly 40 showing how when the release cuff 24 is activated the connection loop 10 opens. This releases the front flying line connection assembly 40 from the harness 58, which tensions the safety line 20 via a leash 60 that is connected to the user 52, thus pulling first front flying line 4A.

Figure 10:
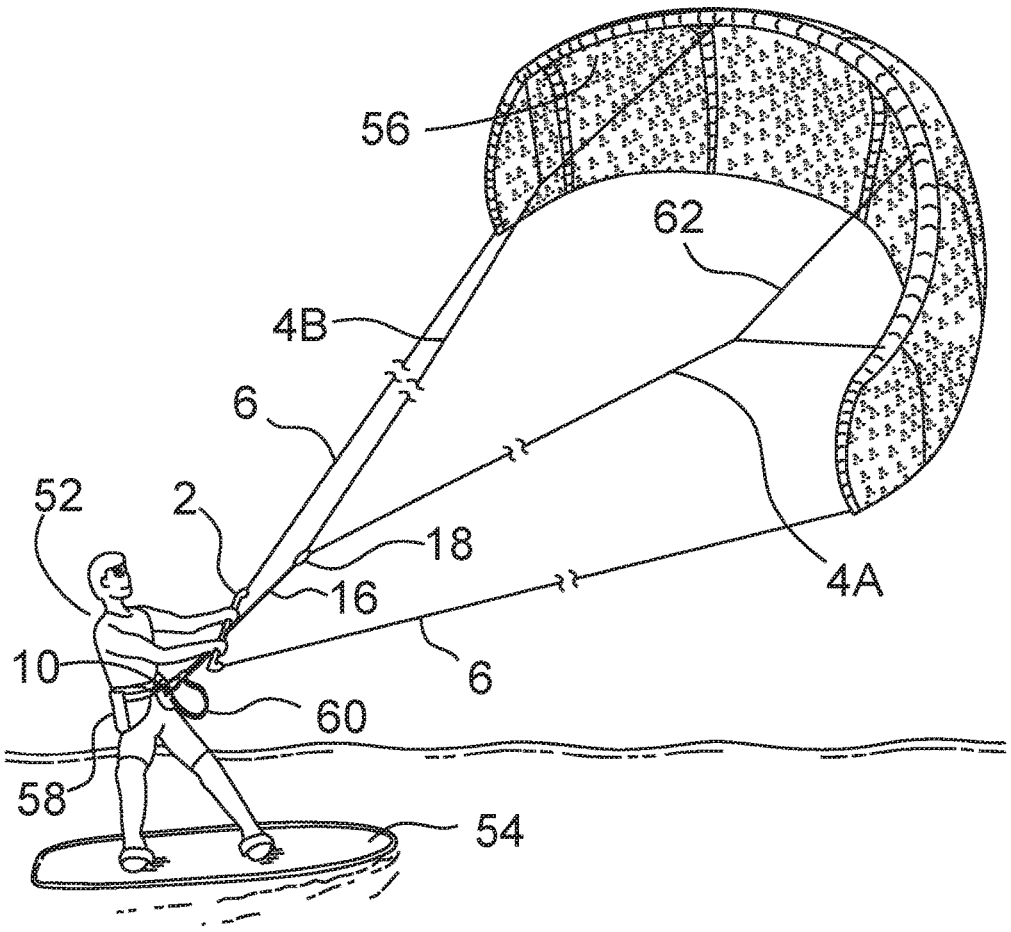
FIG. 10 is a perspective view of the front kite depower system of FIG. 1 when used with a kite powered.

FIG. 10 is a perspective view of the user 52, riding on a board 54 and wearing a harness 58 connected to the front flying line connection assembly 40 via a connection loop 10 with a leash 60 that connects to a harness 58 and to safety line 20. The kite 56 has bridles 62 along the leading edge of the kite 56. First front flying line 4A and second front flying line 4B connect to these bridle lines 62. The rear flying lines 6 connect to the kite 56 near the rear wingtips.

Figure 11:
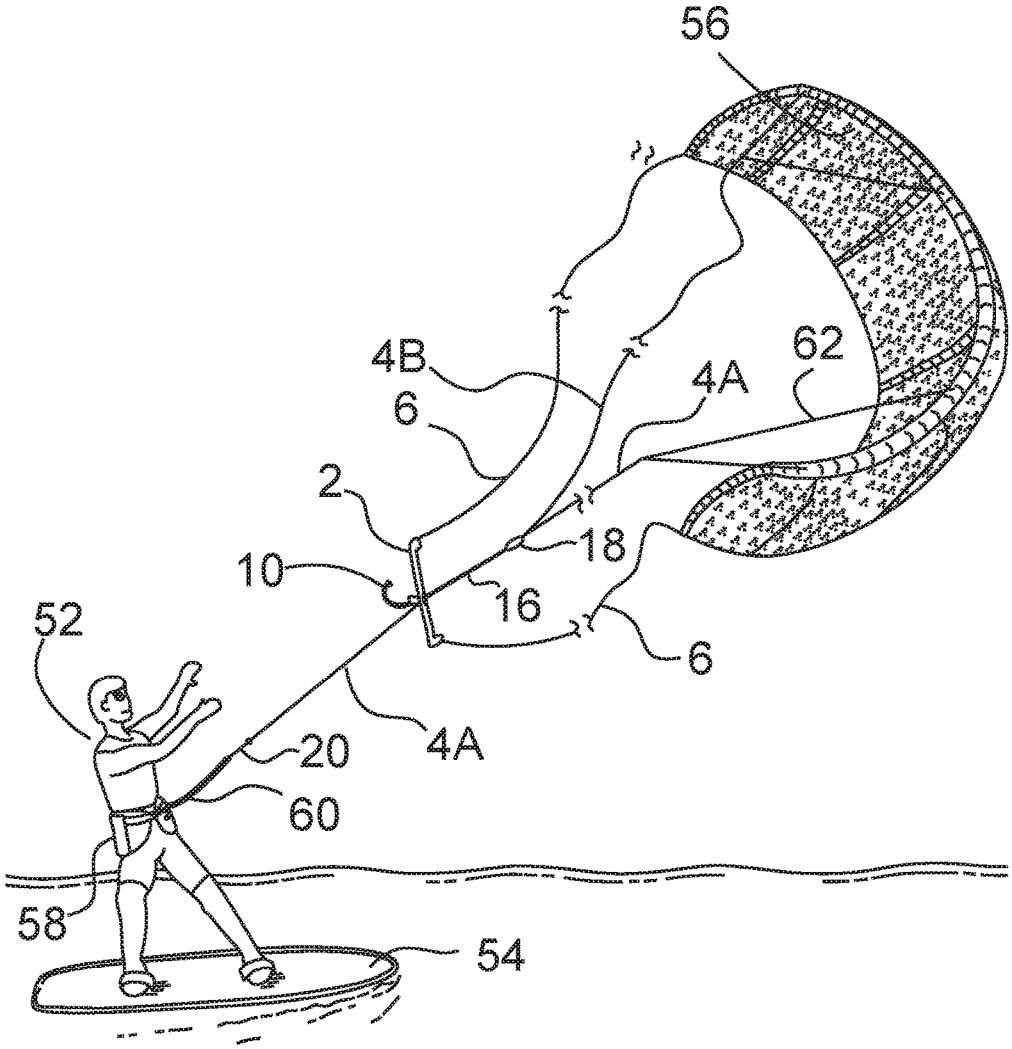
FIG. 11 is a perspective view of the front kite depower system of FIG. 1 when released to depower the kite.

FIG. 11 is a perspective view of the user 52 after they have activated the release cuff 24 on the front flying line connection assembly 40. The safety line 20 that is connected to leash 60 that is connected to harness 58 is now taking all the load of a single front flying line, namely first front flying line 4A, thus depowering the kite 56.

Operation:

Referring to FIG. 5, when a manual rotation force is imparted to line sheath 16 via the manual rotation grip provided by manual rotation cap 12, both line sheath 16 and rotatable hub 14 rotate. Referring to FIG. 3, as front flying line parting fitting 18 rotates with line sheath 16, the relative positioning of first front flying line 4A and second front flying line 4B is altered to untangle any twisting of first front flying line 4A and second front flying line 4B above line sheath 16. Referring to FIG. 5, within line sheath 16, second front flying line 4B, which is off-set from primary axis 5, orbits first front flying line 4A which remains positioned on primary axis 5 to avoid any tangling of first front flying line 4A and second front flying line 4B within line sheath 16 during manual adjustment.

Figure 6:
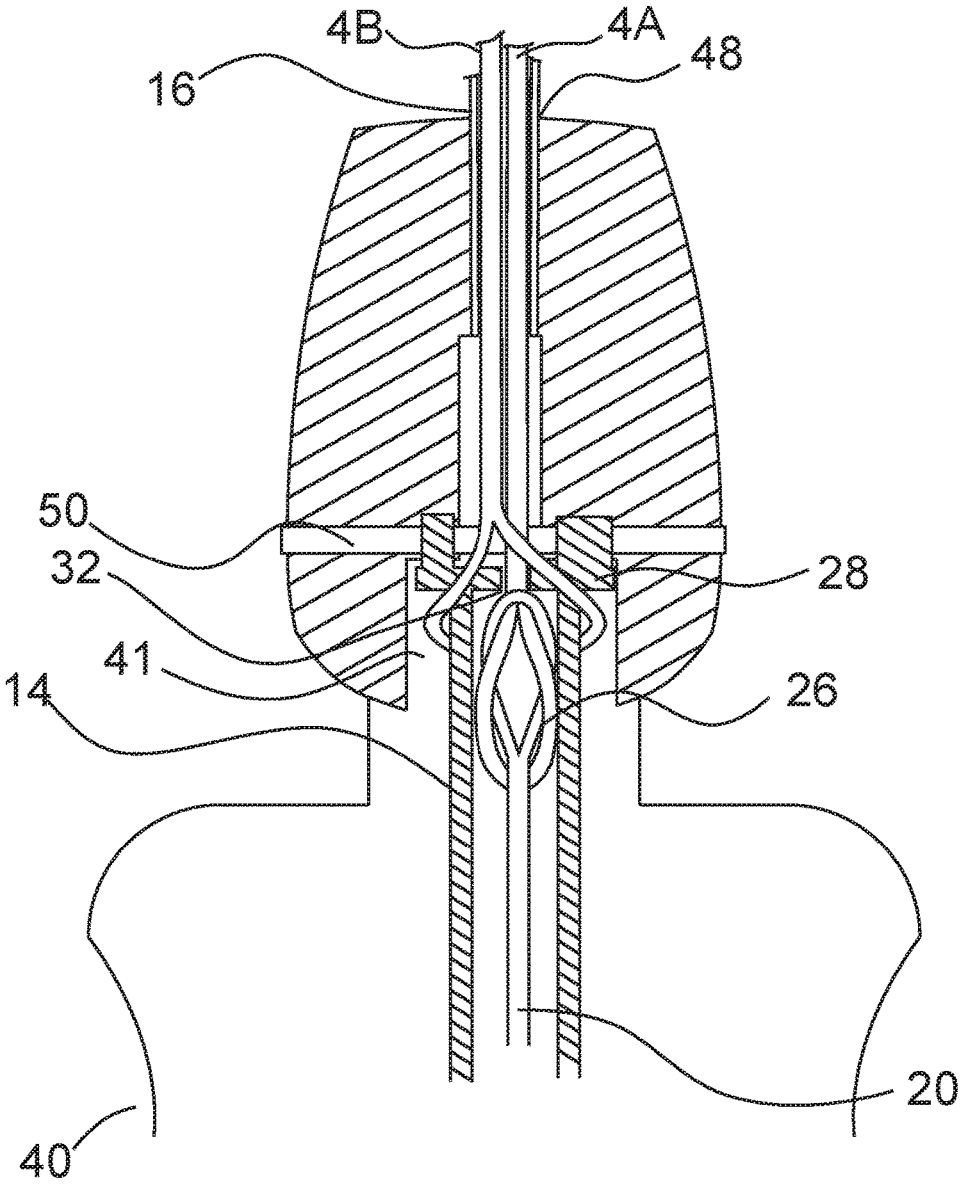
FIG. 6 is a detailed front elevation view, in section, of an alternative embodiment of manual rotation cap and rotation hub.

Referring to FIG. 5, second front flying line 4B is affixed to rotation hub 14 creating a fixed front flying line. First front flying line 4A connects through opening 32 in rotation hub 14 to a safety line 20. Referring to FIG. 10 and FIG. 11, safety line 20 in, in turn, connected to a leash 60 which attaches to the users harness 58. Referring to FIG. 6 and FIG. 9, connection point 26 between first front flying line 4A and safety line 20 creates a stop that will not allow safety leash connection ring 22 to pull through to rotation hub 14 with the upward lifting force of the kite thus becoming fixed line when the stop (connection point 26) is under load. If the force on safety line 20 exceeds the force on the stop (connection point 26), this safety line 20 will take load away from all other control lines on the kite.

Referring to FIG. 9, when a user 52 disconnects from connection loop 10, safety line 20 which is connected via safety leash connection ring 22 to a safety leash 60 (shown in FIG. 10 and FIG. 11) becomes the attachment point between user 52 and kite 56. Referring to FIG. 11, if the user is only connected to safety leash 60, and releases front flying line connection assembly 40 from harness 58, first front flying line 4A will take all the pulling force of kite 56, and provide the maximum depower in an emergency.

The rotating line sheath kite and kite de-power system provides a protective sheath over the two front flying lines of a power kite. By rotating the sheath, twists in the two front flying lines can be eliminated allowing for the smooth activation of front flying line kite depower system 1. The rotating line sheath is independent of the two front flying lines and not required to be load bearing.

Consisting of a manual rotation hub at the user connection end and a front line parting fitting located above the control bar, the rotation sheath can be molded in one single piece or made with multiple parts which are then attached together to provide single unit. The length of rotation sheath can be adjusted in length to range of a particular kite style by lengthening or shortening the rotation sheath length. The rotation sheath can be made from tubular material such as polyurethane tubing. The front flying line parting fitting works dual function to separate the two front flying lines for easy rotation, and as a control bar stopper.

The rotation sheath allows the two front flying lines to run uninterrupted from the kite directly to the base of the manual rotation hub. The rotation sheath protects the user's fingers, hands and body from the thin front flying lines and eliminates friction wear from the control bar sliding over the lines.

Both front flying lines 4A and 4B can be of equal length and diameter and run with no sectioning or leaders from the kite connection point to manual rotation hub 14.

The connection point of the front flying lines is below the control bar. No load is taken by rotating sheath 16.

Untwisting of lines can be achieved by manual rotation cap or any portion of the rotation sheath 16 above or below control bar 2.

Figure 4:
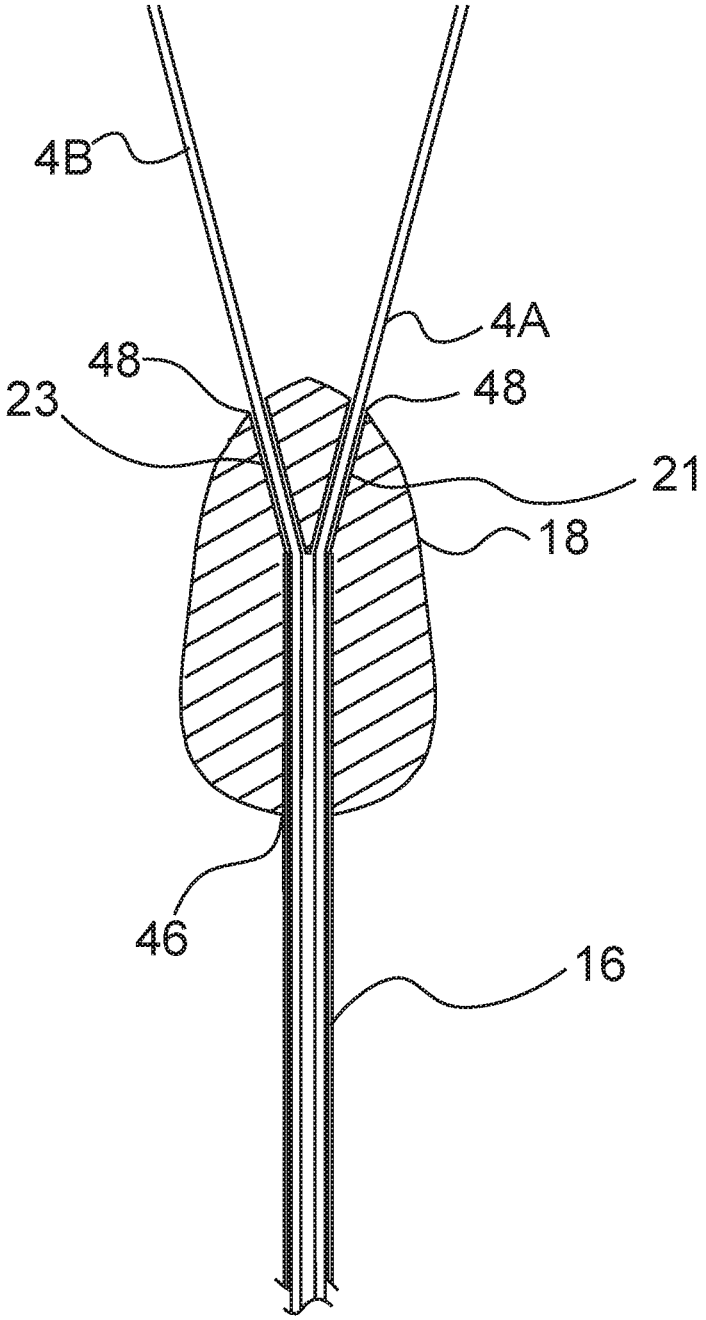
FIG. 4 is a detailed front elevation view, in section, of an alternative embodiment of front flying line parting fitting.

Variations:

FIG. 4 is a front cross sectional view of the front flying line parting fitting 18 showing an alternative method of connecting the rotation sheath 16 to the front flying line parting fitting 18. The rotation sheath 16 enters the bottom opening 46 and is then glued to the front flying line parting fitting 18 thus making a solid connection. The front flying lines 4 enter the top of the front flying line parting fitting 18 through the top openings 48 and the pass down through the rotation sheath 16.

FIG. 6 is a front cross sectional view of the manual rotation cap 12 and the manual rotation hub 14 showing an alternative method of connecting the rotation sheath 16 to the manual rotation cap 12. The manual rotation cap 12 is fixed to the manual rotation hub 14 by a pin 50 that passes through both parts. The end of the rotation sheath 16 is glued in place inside the manual rotation cap 12 making a solid connection. One of the front flying lines 4 exits the rotation sheath 16 and then attaches to front flying line termination attachment 28 which is part of manual rotation hub 14. The other front flying line 4 exits the rotation sheath and then passes through the reduced diameter passageway 32 in the manual rotation hub 14 and then connects to the safety line 20 via a safety line to front flying line connection 26.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A front flying line kite depower system, comprising:

an elongated control bar having a centrally disposed transverse opening defining a primary axis;

a line sheath extending through the transverse opening in the control bar, the line sheath having a lower end and an upper end;

a manual rotation grip fixed to the line sheath, whereby the line sheath is configured to be manually rotated;

a front flying line parting fitting non-rotatably fixed to the upper end of the line sheath above the control bar, the front flying line parting fitting having a first branch and a second branch, the second branch diverging from the first branch;

a front flying line connection assembly positioned below the control bar, the front flying line connection assembly having an opening aligned with the primary axis;

a release cuff with a connection loop forming part of the front flying line connection assembly;

a tubular rotatable hub concentrically positioned in the opening of the front flying line connection assembly;

a first front flying line passing through the first branch of the front flying line parting fitting, extending down the line sheath and passing along the primary axis through the rotatable hub positioned in the opening of the front flying line connection assembly;

a depowering safety line connected to the first front flying line along the primary axis and extending below the front flying line connection assembly;

a second front flying line passing through the second branch of the front flying line parting fitting, extending down the line sheath and connecting off-set from the primary axis to one of the lower end of the line sheath or the rotatable hub;

the lower end of the line sheath being non-rotatably coupled with the rotatable hub, such that when a manual rotation force is imparted to the line sheath via the manual rotation grip, both the line sheath and the rotatable hub rotate, as the front flying line parting fitting rotates with the line sheath the relative positioning of the first front flying line and the second front flying line is altered to untangle any twisting of the first front flying line and the second front flying line above the line sheath, within the line sheath the second front flying line which is off-set from the primary axis orbits the first front flying line positioned on the primary axis to avoid any tangling of the first front flying line and the second front flying line during manual adjustment.

2. The front flying line kite depower system of claim 1, wherein a stop prevents the safety line from passing through the rotatable hub.

* * * * *